US006708367B2

(12) United States Patent
Billson

(10) Patent No.: US 6,708,367 B2
(45) Date of Patent: Mar. 23, 2004

(54) FABRIC GRIPPER

(75) Inventor: Charles Billson, Guernsey (GB)

(73) Assignee: Long Port Investments Limited, Guernsey (GB)

( * ) Notice: Subject to any disclaimer, the term of this patent is extended or adjusted under 35 U.S.C. 154(b) by 82 days.

(21) Appl. No.: 09/837,880

(22) Filed: Apr. 18, 2001

(65) Prior Publication Data

US 2001/0045253 A1 Nov. 29, 2001

(30) Foreign Application Priority Data

Apr. 18, 2000 (GB) ..... 0009402

(51) Int. Cl.[7] ..... A47G 27/04
(52) U.S. Cl. ..... 16/16; 16/7
(58) Field of Search ..... 16/4, 7, 16

(56) References Cited

U.S. PATENT DOCUMENTS

| | | | | | |
|---|---|---|---|---|---|
| 2,211,574 | A | * | 8/1940 | McNicholas | 16/16 |
| 2,514,335 | A | * | 7/1950 | Owens | 16/16 |
| 2,599,580 | A | * | 6/1952 | Paterson et al. | 16/16 |
| 2,631,327 | A | * | 3/1953 | Roberts | 16/16 |
| 2,664,589 | A | * | 1/1954 | Szpilberg | 16/16 |
| 2,806,243 | A | * | 9/1957 | Maex | 16/16 |
| 2,807,826 | A | * | 10/1957 | Vault | 16/16 |
| 2,821,714 | A | * | 2/1958 | Kent et al. | 16/16 |
| 2,928,115 | A | * | 3/1960 | Hill | 16/16 |
| 2,990,565 | A | * | 7/1961 | Atwood | 16/16 |
| 2,995,769 | A | * | 8/1961 | Hill | 16/16 |
| 3,693,212 | A | * | 9/1972 | Handy | 16/16 |
| 3,828,391 | A | | 8/1974 | Sutton et al. | |
| 3,858,269 | A | * | 1/1975 | Sutton et al. | 16/16 |
| 3,950,816 | A | * | 4/1976 | Hill | 16/16 |
| 4,970,754 | A | * | 11/1990 | Anderson et al. | 16/16 |
| 4,974,298 | A | * | 12/1990 | Thallon | 16/16 |

FOREIGN PATENT DOCUMENTS

| | | | | |
|---|---|---|---|---|
| GB | 1511872 | * | 3/1975 | A47G/27/04 |
| GB | 2 113 993 A | | 8/1983 | |
| GB | 2 221 838 A | | 2/1990 | |
| GB | 2 236 477 A | | 4/1991 | |
| GB | 2351539 A | * | 1/2002 | F16B/15/00 |
| GB | 2356566 A | * | 5/2002 | A47G/27/04 |
| JP | 060270197 A | | 9/1994 | |
| JP | 070088979 A | | 4/1995 | |
| JP | 070156197 A | | 6/1995 | |
| JP | 110099565 A | | 4/1999 | |

OTHER PUBLICATIONS

UK Search Report, Aug. 24, 2001.
UK Search Report, Apr. 2, 2002.

* cited by examiner

*Primary Examiner*—Thomas B. Will
*Assistant Examiner*—Alexandra K. Pechhold
(74) *Attorney, Agent, or Firm*—Jenkens & Gilchrist

(57) ABSTRACT

A fabric gripper for securing a fabric or covering to a surface comprises an elongate body and a plurality of upwardly protruding barbs on the upper surface of the body. The gripper is formed as one piece and can either be manufactured from a single thermoplastic material or else the body and barbs can be manufactured of first and second thermoplastic materials, respectively, where the second material is harder than the first material. Where the gripper is to be made of first and second materials, a method of manufacture is provided where the second material is injection molded into channels in the body to form the barbs.

14 Claims, 4 Drawing Sheets

FABRIC GRIPPER

BACKGROUND OF THE INVENTION

The present invention relates to a fixing means for the fixing of fabric or flexible coverings to flooring and walls and a method for manufacturing same.

At present, such fixing means (more commonly known as fabric grippers) comprise a base manufactured from wood or its derivatives or wood pulp, usually in the form plywood or compressed pulp sheets. These sheets are cut into strips with a longitudinal edge of each strip being cut at an angle of between 33 and 50 degrees to the horizontal. The strips of material are then fed into a pinning machine, which introduces the gripping pins into the base at a desired angle. Once the pinned base comes out of the pinning machine, it has securing means—usually nails or screws—placed into the product to secure it to the floor or wall, as required.

The disadvantage of such arrangements is that by having the pins simply inserted into the base, there exists the possibility that the pins may become detached from the base, whether during transit, installation or simply over time whilst in use. Furthermore, the wood material is normally obtained from regions where suppliers are not bound by, or do not adhere to, International legislation requiring the replacement of forested trees. Hence, use of this material can have a significant environmental impact. In addition, when these grippers are no longer required it is not possible to recycle them.

SUMMARY OF THE INVENTION

It is an aim of the present invention to provide a recyclable fabric gripper with integral body and gripping elements. It is a further aim of the present invention to provide a method of producing such an integral gripper that is more efficient and cost effective than existing methods of manufacturing such grippers.

According to a first aspect of the present invention, there is provided a fixing device for the fixing of a covering to a surface, said device comprising an elongate body and a plurality of upwardly protruding barbs arranged on an upper surface of said body, wherein said body and barbs are formed as one piece, and wherein said barbs extend at an angle to the upper surface of less than 90°.

Preferably, said body further comprises fixing means for fixing said body to a surface.

Preferably, said body and barbs are manufactured from a thermoplastic material. Most preferably, said device is manufactured from a thermoplastic material selected from the group comprising polymer alloy blends, PolyVinyl Chloride (PVC), unplasticised PVC, PolyVinylidene Chloride, plasticised or unplasticised Polystyrene, Polypropylene, polycarbonates, Polyethylene Teraphthalate, or PolyButylene Teraphthalate.

Alternatively, said body and barbs are manufactured from first and second thermoplastic materials, respectively, said second material being harder than said first material. Preferably, said thermoplastic materials are selected from the group comprising polymer alloy blends, PolyVinyl Chloride (PVC), unplasticised PVC, PolyVinylidene Chloride, plasticised or unplasticised Polystyrene, Polypropylene, polycarbonates, Polyethylene Teraphthalate, or PolyButylene Teraphthalate. Most preferably, said first material is polypropylene and said second material is nylon.

Preferably, said body is in the form of a parallelepiped.

According to one preferred embodiment, said body comprises a pair of substantially parallel side faces and a pair of substantially parallel end faces, ie. cuboid. According to another preferred embodiment one side face of said body is at an angle to the horizontal. Most preferably, said side face is at an angle of between 30 and 45 degrees to the horizontal.

Preferably, said body further comprises an integral wedge portion adjacent one of said end faces and a projecting portion adjacent the opposite end face. Preferably, said wedge portion comprises a plurality of raised rib portions.

Preferably, each of said plurality of protruding barbs is a skewed cone. Preferably, the axis of said cone is inclined at between 35 and 40 degrees from the horizontal. Preferably, the angle of said cone between 10 and 20 degrees.

Preferably, said fixing means comprises a plurality of nails or screws. Alternatively, said fixing means is an adhesive.

Preferably, said fixing device is recyclable.

Preferably, said fabric is a carpet.

According to a second aspect of the present invention, there is provided a method of producing a fabric fixing device manufactured from first and second plastics materials, said method comprising the steps of:

extruding a first material so as to form an elongate body having at least one channel formed in an upper surface thereof;

placing said elongate body into an injection mould such that a plurality of cavities are formed between said channel and said mould;

injecting a second material into said cavities such that a plurality of upwardly protruding barbs are formed on the upper surface of said body, wherein the second material is harder than the first material.

Preferably, said at least one channel is substantially parallel to the longitudinal axis of the body. Preferably, two channels are formed in said extruding step, each being substantially parallel to the longitudinal axis of the body.

Preferably, the step of placing the body in the mould is carried out automatically following the extruding step.

Preferably, said second material is injected into said cavities through the base of said body.

BRIEF DESCRIPTION OF THE DRAWINGS

Preferred embodiments of the present invention will now be described, by way of example only, with reference to the accompanying drawings, wherein:

FIG. 3(*b*) is a plan view showing the sonic welds of a fabric gripper according to the present invention;

DETAILED DESCRIPTION OF THE PREFERRED EMBODIMENT

Figure 1:
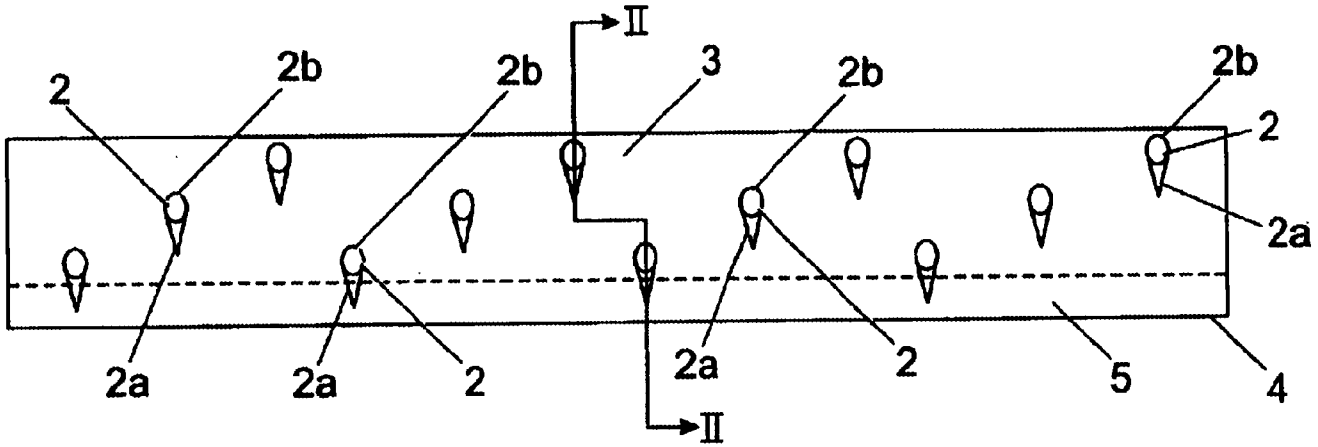
FIG. 1 is a plan view of a fabric gripper in accordance with the present invention.

FIG. 1 shows a plan view of a preferred embodiment of a thermoplastic fabric gripper 1 in its completed state. The gripper 1 comprises a body portion 3 of substantially rectangular cross-section and a number of integral spaced-apart teeth (or barbs) 2. The preferred layout of these teeth 2 is a diagonal pattern along the length of the gripper 1 as shown in FIG. 1, and the wider the gripper is, the more teeth 2 will be provided in the diagonal pattern. In this particular example there are three teeth 2 in each diagonal. The teeth 2 themselves can be seen properly in FIG. 2.

The teeth 2 each have a "shark's tooth" configuration with a front edge 2*a* and a rear edge 2*b*. The preferred angle A for the rear edge 2*b* is 45° from the horizontal.

Figure 2:
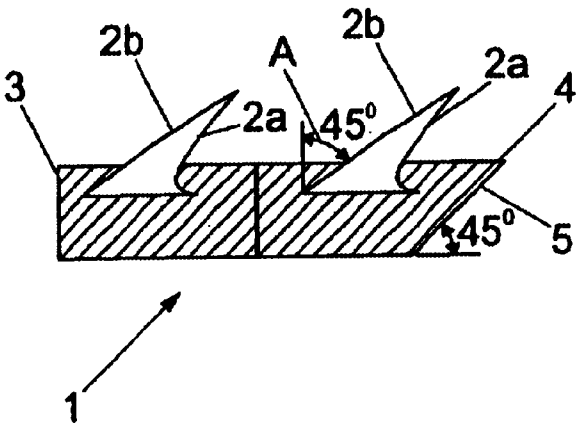
FIG. 2 is a sectional view of the carpet gripper shown in FIG. 1 along line II—II.

FIG. 2 also shows that one of the longitudinal sides 5 of the rectangular body 3 is angled so that a return edge 4 is provided. With the provision of the return edge 4, the edge of a fabric covering can be tucked around the return edge 4 of the gripper 1 to supplement the fixing provided by the teeth 2. Ideally, the angle of the longitudinal side is between 30–45° to the horizontal.

In this particular embodiment, the body portion 3 and teeth 2 are made from different materials. This is so that the teeth 2 may be hard and rigid whilst the body portion 3 is soft and pliable so that it may be easily nailed or screwed to a surface. The preferred materials for the teeth 2 and body 3 are nylon and polypropylene, respectively. How the teeth 2 and body 3 are put together to arrive at the complete gripper shown in FIG. 1 will be described below.

Figure 3A:
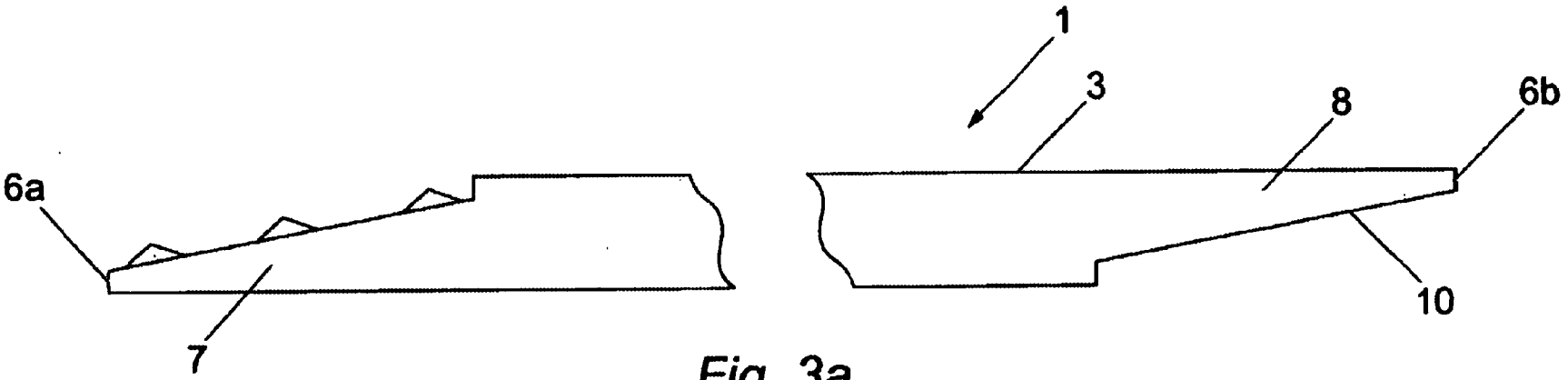
FIG. 3(*a*) is a schematic front elevation showing the co-operation of a pair of fabric grippers in accordance with the present invention.
Figure 3B:
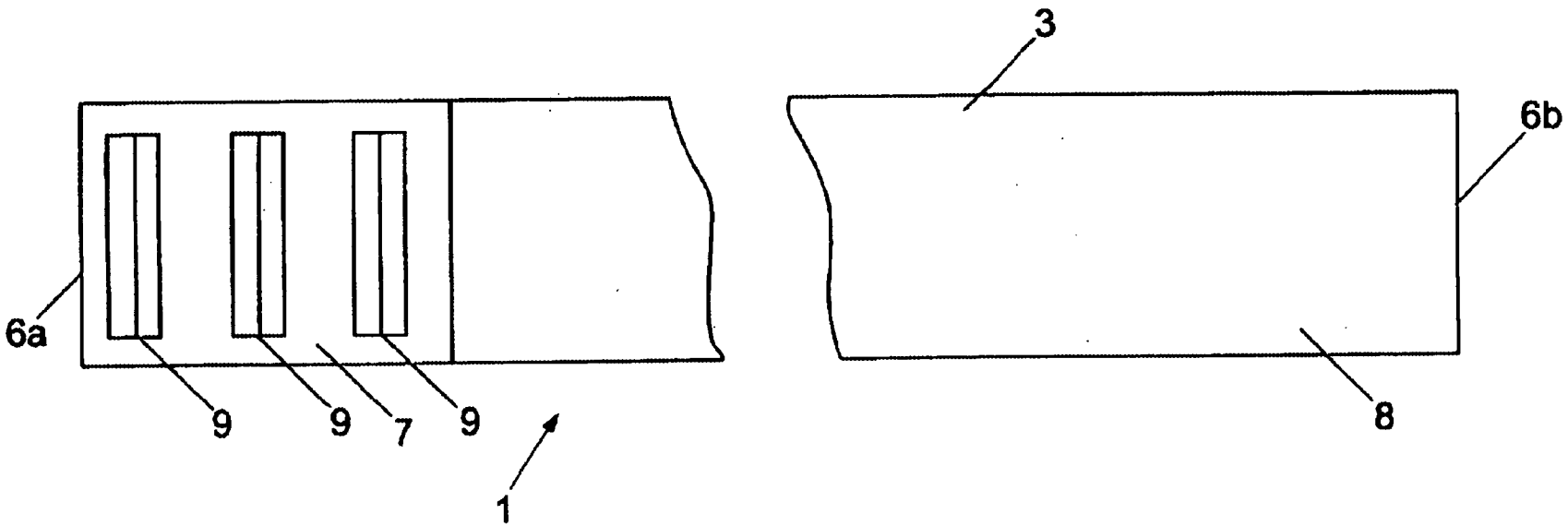

FIGS. 3(*a*) and (*b*) shows a schematic view of how individual grippers 1 may be produced so that they may be joined together end-to-end. The grippers 1 can be produced so that an integral wedge section 7 is provided at one end 6*a* of the gripper 1. At the opposite end 6*b* of the gripper 1, a corresponding integral protruding portion 8 is provided. The wedge section 7 is moulded so as to provide a number of raised strips 9. The preferred means of interconnecting the grippers 1 is by positioning the protruding portion 8 of one gripper 1 over the wedge section 7 of an adjacent gripper, with the underside 10 of the protruding portion 8 lying against the raised strips 9. Very high frequency sound waves are then passed through the two adjacent sections 7,8 causing the raised strips 9 to melt during the sonic welding. The melting of the strips 9 forms a bond between the underside 10 of the protruding section 8 and the upper face of the wedge portion 7 so that the two grippers 1 are fixed together end-to-end. In this way, any number of grippers 1 may be laid uninterrupted along a surface.

Figure 4A:
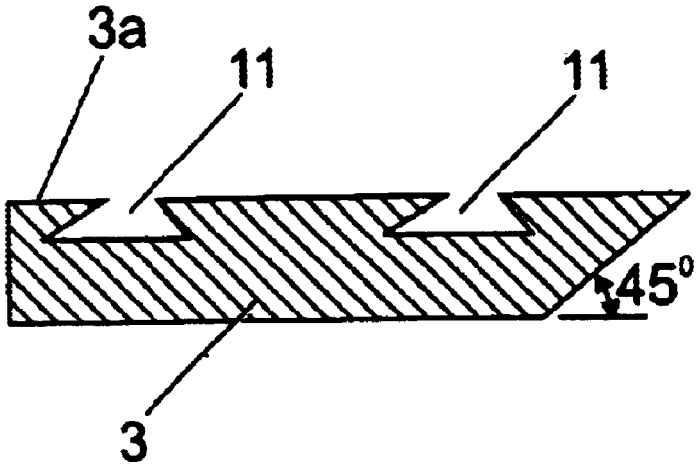
FIGS. 4(*a*) and 4(*b*) show cross sectional and projected views, respectively, of the body portion of the fabric gripper.
Figure 4B:
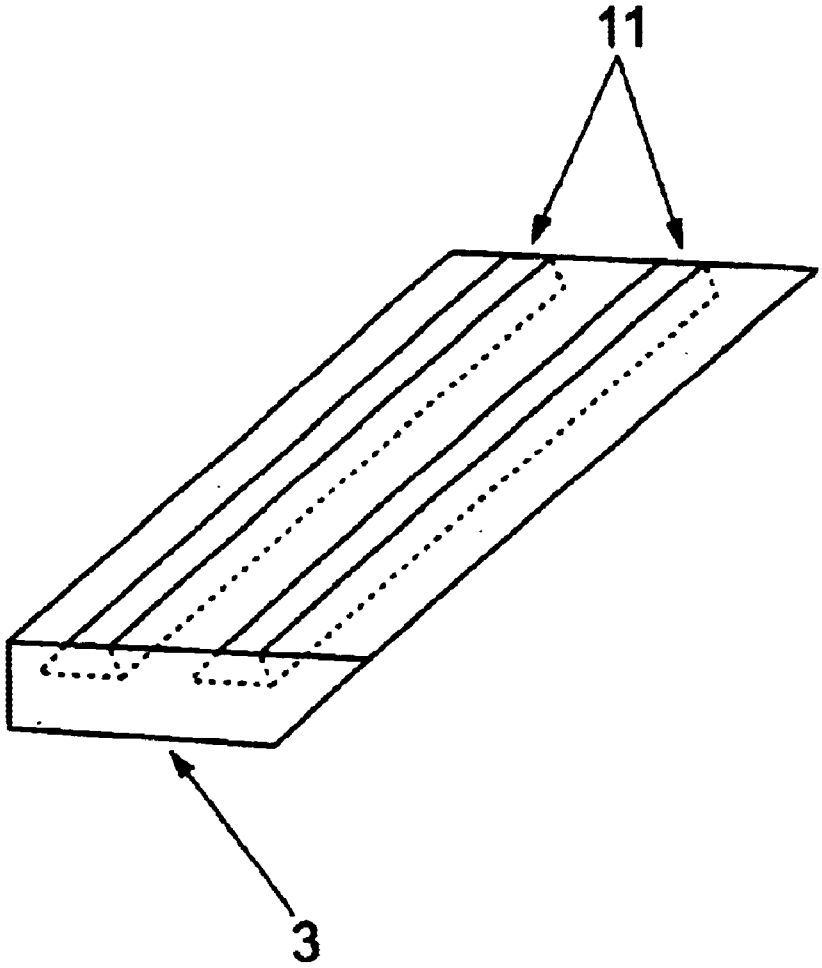

FIGS. 4(*a*) and 4(*b*) show views of the body portion 3 prior to the introduction of the teeth 2. The body 3 is extruded in such a manner as to provide channels 11 which run longitudinally along the upper surface 3*a* of the body portion 3. The number of channels 11 in the body 3 corresponds to the desired number of rows of teeth 2. In the embodiment shown, two channels are provided, but for the example shown in FIG. 1, three channels 11 would be required. The number of channels 11 depends on the requirements of the job which the gripper 1 will be performing.

Figure 5:
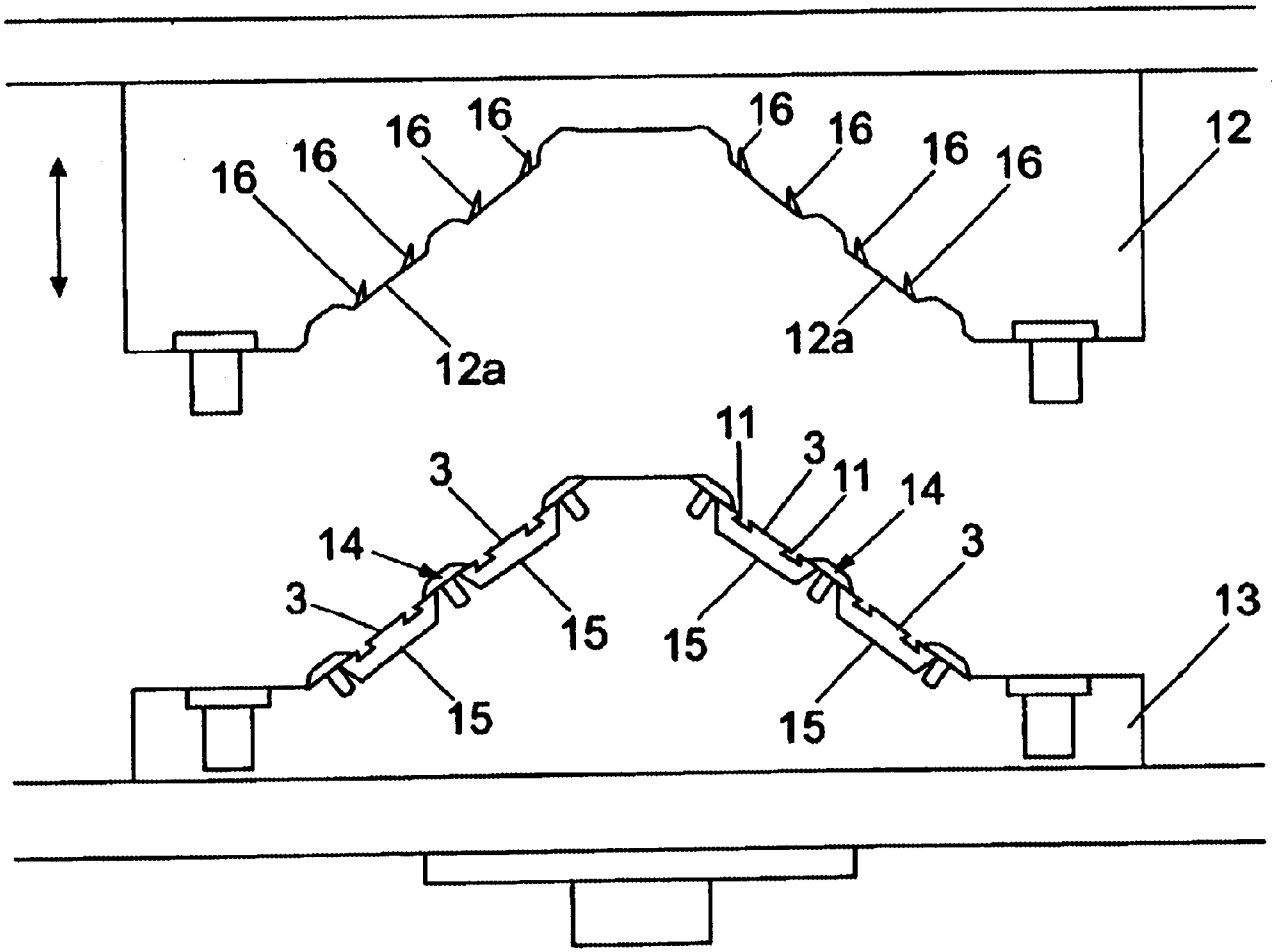
FIG. 5 shows an end elevation of an injection moulding apparatus as used in production of the fabric gripper.

FIG. 5 shows a preferred embodiment of a mould press used in the production of the gripper 1. For clarity, the mould is shown in its open position, the mould cover 12 being raised away from the mould base 13. The mould base 13 has a raised central portion that provides a pair of mould faces 14. The mould faces 14 are angled at 45° to the horizontal on the base 13 and contain recesses 15 which receive the extruded body portions 3. A pattern of recesses 16 which correspond to the preferred shape of the teeth 2 are provided in the mould face 12*a* of the mould cover 12. Once the mould cover 12 is closed, the channels (as shown in FIGS. 4(*a*) and 4(*b*)) and the recesses 16 form a number of cavities in preparation for the introduction of the material which forms the teeth 2.

The manufacturing process will now be described in more detail. Following extrusion of the body portions 3 as previously described, the body portions 3 are inserted into the recesses 15, preferably automatically. The mould cover 12 is then closed down, leaving the cavities between the body 3 and the mould face 12 that define the teeth 2. Once the mould is completely closed, plasticised nylon is forced into the cavities, the nylon assuming the desired shape of the teeth 2. In this particular embodiment, the nylon is injected into the cavities by way of a number of hot injector nozzles (not shown) which, due to their heat, pass through the base of the body portion and inject the nylon directly into the cavities from underneath the channels 11. Once the thermoplastic nylon has set in the mould, the mould cover 12 is opened and the finished moulded grippers 1 can be removed, again preferably automatically. With the material for the teeth 2 being injected into the channels 11 in this way, it is held fast in the channels 11 when it sets, thereby improving the robustness of the gripper.

An advantage of having the gripper made from two different materials is that the teeth—which must be very strong—can be made from a strong, hard material such as nylon without incurring the extra cost of manufacturing the whole gripper from that material. The cost of a material such as nylon is high, and so with the use of two materials, the gripper can be made with strong teeth without incurring the cost penalties of producing the whole gripper from that material. With a softer material such as polypropylene for the body, the body can be easily nailed or screwed to a surface.

It is to be understood that although the above is a description of a preferred embodiment of the gripper strip and a method for production thereof, there are other alternative embodiments which are possible. For instance, the layout of the teeth 2 of the gripper 1 is not restricted to a diagonal layout, but may also be a zig-zag or criss-cross pattern, or the teeth may be formed in uniform rows and/or columns.

Another possible modification is in the method of fixing a number of strips together end-to-end. Although the preferred method is to use sonic welding, other methods such as adhesive bonding or gluing may also be used. Furthermore, the gripper itself or the individual components thereof can be manufactured from a range of recyclable crosslinked or thermoplastic polymeric materials such as polymer alloy blends, PolyVinyl Chloride (PVC), unplasticised PVC, PolyVinylidene Chloride, plasticised or unplasticised Polystyrene, Polypropylene, polycarbonates, Polyethylene Teraphthalate, or PolyButylene Teraphthalate.

The gripper may also be attached to a floor or wall by a variety of different methods, such as fixing by nails or screws, or bonded by adhesives. Finally, it is also to be understood that injection moulding is not the only method that could be used to produce the carpet gripper of the present invention. Alternative methods such as casting or vacuum moulding may also be used. Furthermore, although the preferred method of manufacture involves the material of the teeth being injected from underneath the body portions, it can easily be adapted so that the material is injected from above the cavities—from within the mould cover, for example.

These and other modifications and improvements can be incorporated without departing from the scope of the invention.

What is claimed is:

1. A fixing device for the fixing of a covering to a surface, said device comprising an elongate body and a plurality of upwardly protruding barbs arranged on an upper surface of said body, wherein said body and barbs are formed as one piece and are manufactured from first and second thermoplastic materials, respectively, said second material being harder than said first material, and wherein said barbs extend at an angle to the upper surface of less than 90°.

2. The fixing device of claim 1, wherein said first material is polypropylene and said second material is nylon.

3. The fixing device of claim 1, wherein said body is in the form of a parallelepiped.

4. The fixing device of claim 1, wherein one side face of said body is at an angle to the horizontal.

5. The fixing device of claim 4, wherein the side face is at an angle of between 30 and 45 degrees to the horizontal.

6. The fixing device of claim 1, wherein said body further comprises a pair of end faces, wherein an integral wedge portion is provided adjacent one of said end faces and a projecting portion is provided adjacent the opposite end face.

7. The fixing device of claim 6, wherein said wedge portion comprises a plurality of raised rib portions.

8. The fixing device of claim 1, wherein each of said plurality of protruding barbs is a skewed cone.

9. The fixing device of claim 1, wherein the device is recyclable.

10. A method of producing a fabric fixing device manufactured from first and second plastics materials, said method comprising the steps of:

extruding a first material so as to form an elongate body having at least one channel formed in an upper surface thereof;

placing said elongate body into an injection mould such that a plurality of cavities are formed between said channel and said mould;

injecting a second material into said cavities such that a plurality of upwardly protruding barbs are formed on the upper surface of said body, wherein the second material is harder than the first material.

11. The method of claim 10, wherein said at least one channel is substantially parallel to the longitudinal axis of the body.

12. The method of claim 10, wherein two channels are formed in said extruding step, each being substantially parallel to the longitudinal axis of the body.

13. The method of claim, 10, wherein the step of placing the body in the mould is carried out automatically following the extruding step.

14. The method of claim 10, wherein said second material is injected into said cavities through the base of said body.

* * * * *